US006863749B1

(12) United States Patent
Leap

(10) Patent No.: US 6,863,749 B1
(45) Date of Patent: Mar. 8, 2005

(54) METHOD OF IMPROVING THE TOUGHNESS OF LOW-CARBON, HIGH-STRENGTH STEELS

(75) Inventor: Michael J. Leap, Massillon, OH (US)

(73) Assignee: The Timken Company, Canton, OH (US)

( * ) Notice: Subject to any disclaimer, the term of this patent is extended or adjusted under 35 U.S.C. 154(b) by 317 days.

(21) Appl. No.: 10/048,293

(22) PCT Filed: Jul. 26, 2000

(86) PCT No.: PCT/US00/40483

§ 371 (c)(1),
(2), (4) Date: Apr. 22, 2002

(87) PCT Pub. No.: WO01/07667

PCT Pub. Date: Feb. 1, 2001

Related U.S. Application Data

(60) Provisional application No. 60/145,788, filed on Jul. 27, 1999.

(51) Int. Cl.[7] ..... C21D 9/00

(52) U.S. Cl. ..... 148/548; 148/547; 148/660; 148/664; 148/654

(58) Field of Search ..... 148/548, 547, 148/654, 660, 664, 320

(56) References Cited

U.S. PATENT DOCUMENTS 4,092,178 A * 5/1978 Onoe et al. ..... 148/541
4,634,573 A 1/1987 Yanagiya et al.
5,409,554 A 4/1995 Leap

FOREIGN PATENT DOCUMENTS

EP 0 900 850 A2 3/1999
JP (1985) 60-159155 A 8/1985
WO WO 98/50594 A1 11/1998

OTHER PUBLICATIONS

Leap, Michael J. et al., "How to Make Strong Steel Tougher", *Advanced Materials & Processes,* 8/97, 4 pp.

Patent Abstracts of Japan, JP 01–092320 published Nov. 04, 1989, Applicant Kawasaki Steel Corp, entitled "Improvement of Toughness of Joint of High Tension Steel Subjected to Flash Butt Welding".

* cited by examiner

*Primary Examiner*—Deborah Yee
(74) *Attorney, Agent, or Firm*—Webb Ziesenheim Logsdon Orkin & Hanson, P.C.

(57) ABSTRACT

A method of post-solidification processing to minimize the content of extremely coarse grain-refining precipitates that may form during solidification is low-alloy and alloy high-strength steels containing approximately 0.09–0.17% by weight C so as to provide improved toughness in a wrought and heat-treated product. The method entails cooling an as-cast steel at a reduced rate in a furnace held at a temperature in excess of the equilibrium solution temperature for AlN in austenite. The steel is maintained at this temperature for a sufficient amount of time to effect the dissolution of coarse AlN precipitates in the microstructure, and the so-treated steel is then cooled at any desired rate to room temperature or to a hot-rolling temperature.

11 Claims, 5 Drawing Sheets

METHOD OF IMPROVING THE TOUGHNESS OF LOW-CARBON, HIGH-STRENGTH STEELS

This application claims the benefit of Provisional Application No. 60/145,788, filed Jul. 27, 1999.

BACKGROUND OF THE INVENTION

1. Field of the Invention

The present invention relates generally to improving the toughness of low-carbon, high-strength steels and, more particularly, to a method of post-solidification processing to minimize the content of coarse grain-refining precipitates that may form during solidification in low-alloy and alloy high-strength steels containing approximately 0.09–0.17% by weight C.

2. Description of the Related Art

The toughness of grain-refined, high-strength steels is highly dependent on the content of coarse AlN precipitates in the microstructure, as discussed in M. J. Leap et al., SAE Paper 961749, 1996; and M. J. Leap et al., 38$^{th}$ Mechanical Working & Steel Processing Conference Proceedings, Iron and Steel Society, Inc., 1996, pp. 195–220. It is also known that coarse AlN precipitates degrade the toughness of high-strength steels over a broad range of test temperature by providing preferential sites in the microstructure for the formation of transgranular cleavage facets, quasi-cleavage facets, and secondary microvoids. This behavior is disclosed in several publications: M. J. Leap et al., ASTM STP 1259, 1997, pp. 160–195; M. J. Leap et al., 39$^{th}$ Mechanical Working & Steel Processing Conference Proceedings, Iron and Steel Society, Inc., 1997, pp. 685–703; and M. J. Leap et al., Metallurgical Transactions A, vol. 30A, 1999, pp. 93–114. Although high-strength steels containing less than about 0.1 wt. % C or between 0.2 wt. % C and 0.4 wt. % C may exhibit AlN precipitates up to about 400 nm in size, it is known that these precipitates can be dissolved during the reheating operation that precedes finish rolling or forging. U.S. Pat. No. 5,409,554, for example, describes a process for optimizing toughness in which reheating for the last hot-working operation is conducted at a temperature in the vicinity of the least soluble species of grain-refining precipitate in a steel.

It has been more recently found that grain-refined, high-strength steels containing approximately 0.09–0.17 wt. % C may exhibit extremely coarse AlN precipitates after hot working and heat treating. The coarse precipitates, which degrade the toughness of tempered martensite, are not readily eliminated from the microstructure with thermal/thermomechanical processes of the prior art. However, many low-alloy and alloy steels containing about 0.09–0.17 wt. % C are utilized in structural, mining, and oil field applications that have demanding toughness requirements, and the development of marginal toughness in combination with high variability in toughness has exemplified the need to improve the toughness of these steels in various products.

An example of the toughness degradation that results from the presence of extremely coarse grain-refining precipitates in tempered martensite is provided by two grain-refined, high-strength 9313M steels, the compositions of which are listed in Table 1. Sections of wrought bar from the two heats, designated steels A and B, were forged, carburized at 954° C. for eight hours, reaustenitized at 829° C. for two hours, oil quenched, and tempered at 204° C. for four hours. Charpy V-notch specimens were extracted from the forged and heat treated components in the longitudinal orientation and tested at room temperature in accordance with ASTM E23. Steels A and B, while possessing similar compositions, microstructure, and strength, exhibit room-temperature impact toughness values of 61 J and 14 J, respectively. The large difference in the toughness of the two steels primarily reflects different amounts of ductile crack extension from the notch root of Charpy specimens prior to unstable fracture. The abrupt change in fracture mode to cleavage/quasi-cleavage (steel B) and cleavage/quasi-cleavage intermixed with small amounts of ductile rupture (steel A) results from the presence of particles larger than a critical size that is defined in terms of the strength and strain hardening capacity of the matrix microstructure. Low densities of small to intermediate-sized TiN precipitates are observed on the fracture surfaces, particularly in regions of ductile rupture on the steel A specimen. However, both steels exhibit a preponderance of coarse AlN precipitates on the fracture surfaces of the Charpy V-notch specimens, which indicates that coarse AlN precipitates are the microstructural feature responsible for the initiation of a majority of local fracture events that produce cleavage/quasi-cleavage facets, FIG. 1.

TABLE 1

| | Steel Chemistries (weight percentages) | | | | | | | | | | | |
|---|---|---|---|---|---|---|---|---|---|---|---|---|
| Steel | C | Mn | Si | Cr | Ni | Mo | S | P | Ti | Al | N (ppm) | O (ppm) |
| A | 0.14 | 0.69 | 0.22 | 1.45 | 3.23 | 0.10 | 0.006 | 0.009 | 0.002 | 0.023 | 92 | 8 |
| B | 0.15 | 0.70 | 0.24 | 1.43 | 3.25 | 0.12 | 0.002 | 0.009 | 0.003 | 0.026 | 96 | 6 |

Size distributions of AlN precipitates located in the unstable fracture region of Charpy V-notch specimens are shown in FIGS. 2*a* and 2*b* for the two steels. The dispersion of AlN precipitates on the fracture surface of the Charpy specimen with comparatively high toughness (steel A) exhibits a mean size of 132 nm, whereas the steel B specimen exhibits a somewhat coarser AlN dispersion with a mean size of 169 nm. A majority of the AlN precipitates in both steels are less than 400 nm in size, although low densities of AlN precipitates as large as 1 $\mu$m are present on the fracture surface of the steel B specimen. The steel B specimen also exhibits a higher area density of precipitates on the fracture surface than the steel A specimen.

Second-phase dispersions in metals typically exhibit a log-normal distribution of feature size when the formation of the dispersion is governed by a single mechanism over a range of temperature. However, the grouped size data for the two steels exhibit significant departures from log-normal behavior at large precipitate sizes, FIG. 2*c*. The bilinear nature of the cumulative size distributions indicates that the extremely coarse AlN precipitates form at drastically different temperatures than the smaller precipitates in both steels.

This observation is corroborated by thermodynamic calculations that predict the presence of TiN and AlN in the solute-enriched interdendritic liquid during solidification in a 9313M base composition containing aluminum and nitrogen in contents representative of grain-refining additions, FIG. 3. Since solute enrichment is driven by large differences in the solubility of alloying elements in the solid and liquid phases, the general precipitation reaction is prevalent in steels containing substantial amounts of δ ferrite during solidification, i.e., steels containing about 0.09–0.17 wt. % C.

The data for steels A and B of Table 1 indicates that increases in the size and content of the coarsest AlN precipitates in a dispersion degrade toughness. Thus, the precipitation of AlN during solidification is particularly important in that substantial contents of extremely coarse precipitates may form in air-melt steels with aluminum in concentrations representative of a grain-refining addition, i.e., 0.005–0.050 wt. %. The present invention addresses the need to improve the toughness of air-melt, high-strength steels containing about 0.09–0.17 wt. % C by providing a commercially viable process for minimizing the content of extremely coarse AlN precipitates in the tempered martensitic microstructure of the final product.

SUMMARY OF THE INVENTION

The present invention provides improved toughness in low-alloy and alloy high-strength steels containing about 0.09–0.17 wt. % C by substantially reducing the size and content of extremely coarse grain-refining precipitates that may form in the solute-enriched interdendritic liquid during solidification. Improved toughness results from cooling the as-solidified steel at a reduced rate to promote the dissolution of coarse AlN precipitates at high temperatures in the austenite phase field.

DETAILED DESCRIPTION OF THE INVENTION

Figure 1:
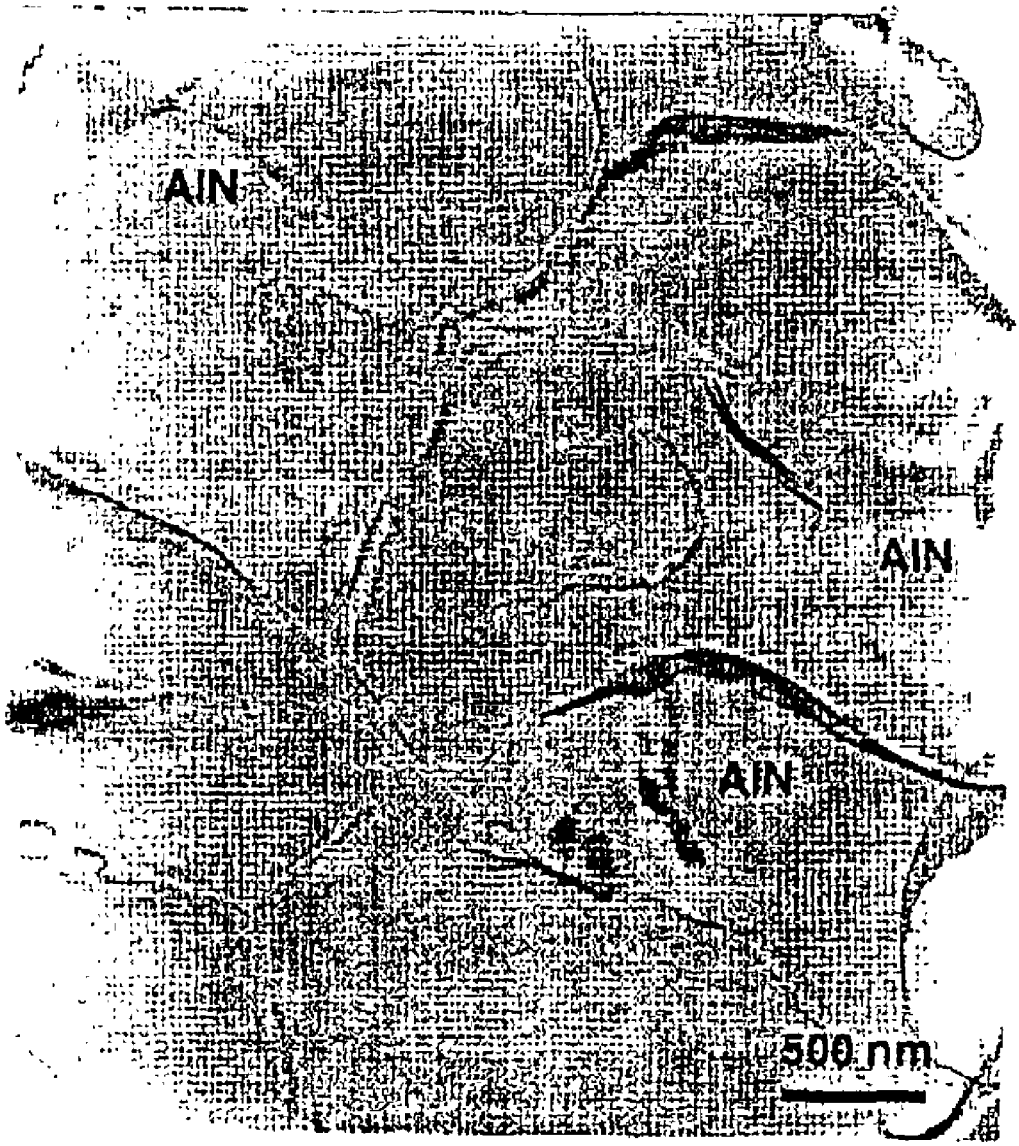
FIG. 1 is a transmission electron photomicrograph illustrating the presence of extremely coarse AlN precipitates on the fracture surface of a Charpy V-notch specimen of steel B of Table 1.
Figure 2:
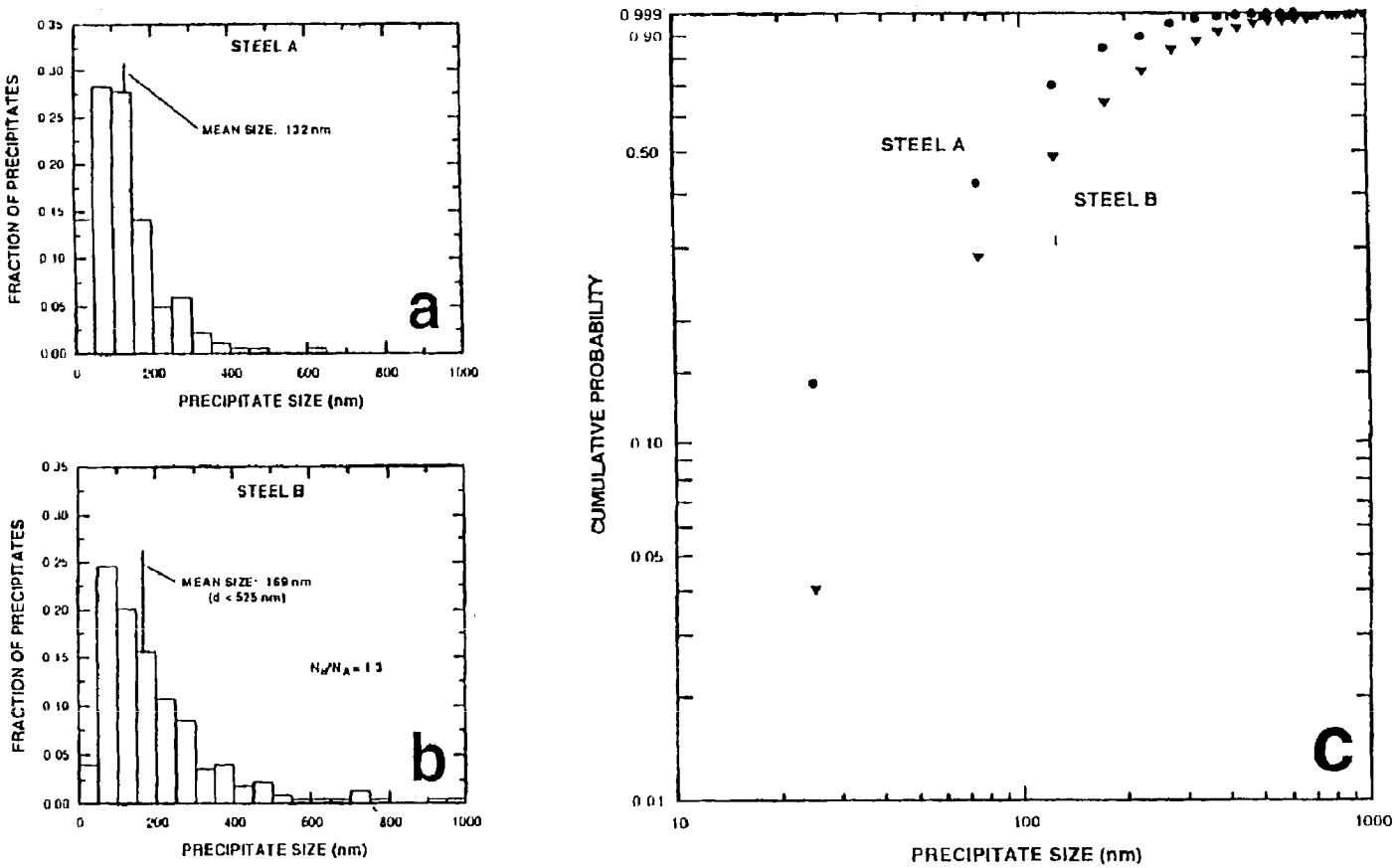
FIGS. 2*a*–2*c* are graphs showing size distribution of AlN precipitates on the fracture surfaces of Charpy V-notch specimens of steels A and B of Table 1.
Figure 3:
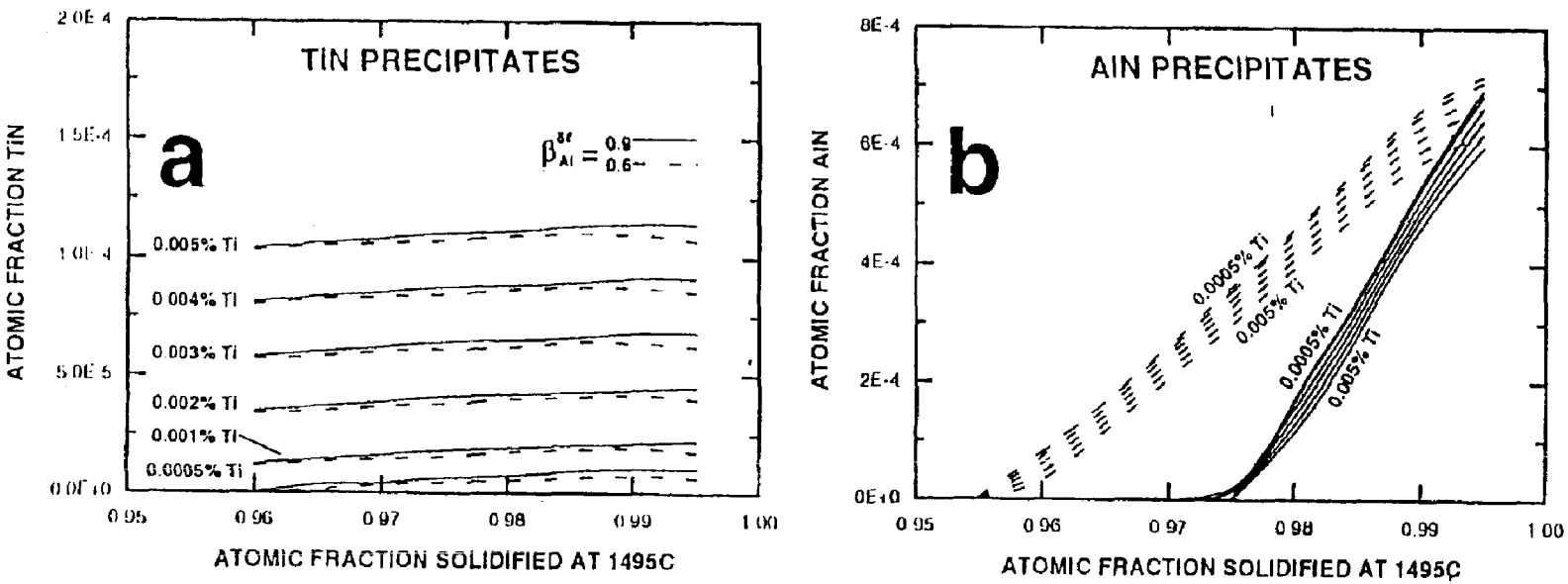
FIGS. 3*a* and 3*b* are graphs illustrating thermodynamic estimates of the atomic fraction of TiN and AlN in the solute-enriched interdendritic liquid as a function of the local atomic fraction solidified at 1495° C. for the steel B composition of Table 1. The calculations, which represent conditions associated with a comparatively high solidification rate (i.e., local equilibrium at the δ ferrite-liquid interface), are shown for the lower bounding value and the generally accepted value of aluminum partition ratio, $\beta_{Al}$, between δ ferrite and liquid steel.

The precipitation of AlN in the solute-enriched interdendritic liquid provides a necessary condition for the embrittlement phenomenon in low-carbon steels, through a sufficient condition for embrittlement requires the retention of coarse precipitates through post-solidification cooling. Methods of effectively controlling this phenomenon are limited to restricting the amount of AlN that precipitates during solidification and/or the amount of AlN that is retained through post-solidification cooling. Decreasing the rate of solidification in the columnar zone of a casting, for example, can minimize the microsegregation-induced precipitation of AlN, although methods to practically achieve this objective in a commercial environment can be somewhat cost intensive. Compositional modifications to limit the extent of AlN precipitation are also of limited utility. In particular, gettering a portion of the nitrogen with titanium, as shown in FIG. 3, is only predicted to have a second-order effect on the content of AlN that forms during the latter stages of solidification. Therefore, the most viable method of controlling the phenomenon is to effect the dissolution of coarse AlN precipitates in the as-solidified steel.

The method of the present invention entails cooling an as-solidified steel at a reduced rate to promote the dissolution of coarse AlN precipitates at high temperatures in the austenite phase field. This method of processing is based on the large chemical driving force for AlN dissolution in austenite that results from a large difference between the solidification temperature and the equilibrium AlN solution temperature. For example, the peritectic temperature for the iron-carbon system (1495° C.) is significantly higher than calculated estimates of AlN solution temperature that range from 1060° C. to 1188° C. for the steel B composition of Table 1.

Figure 4:
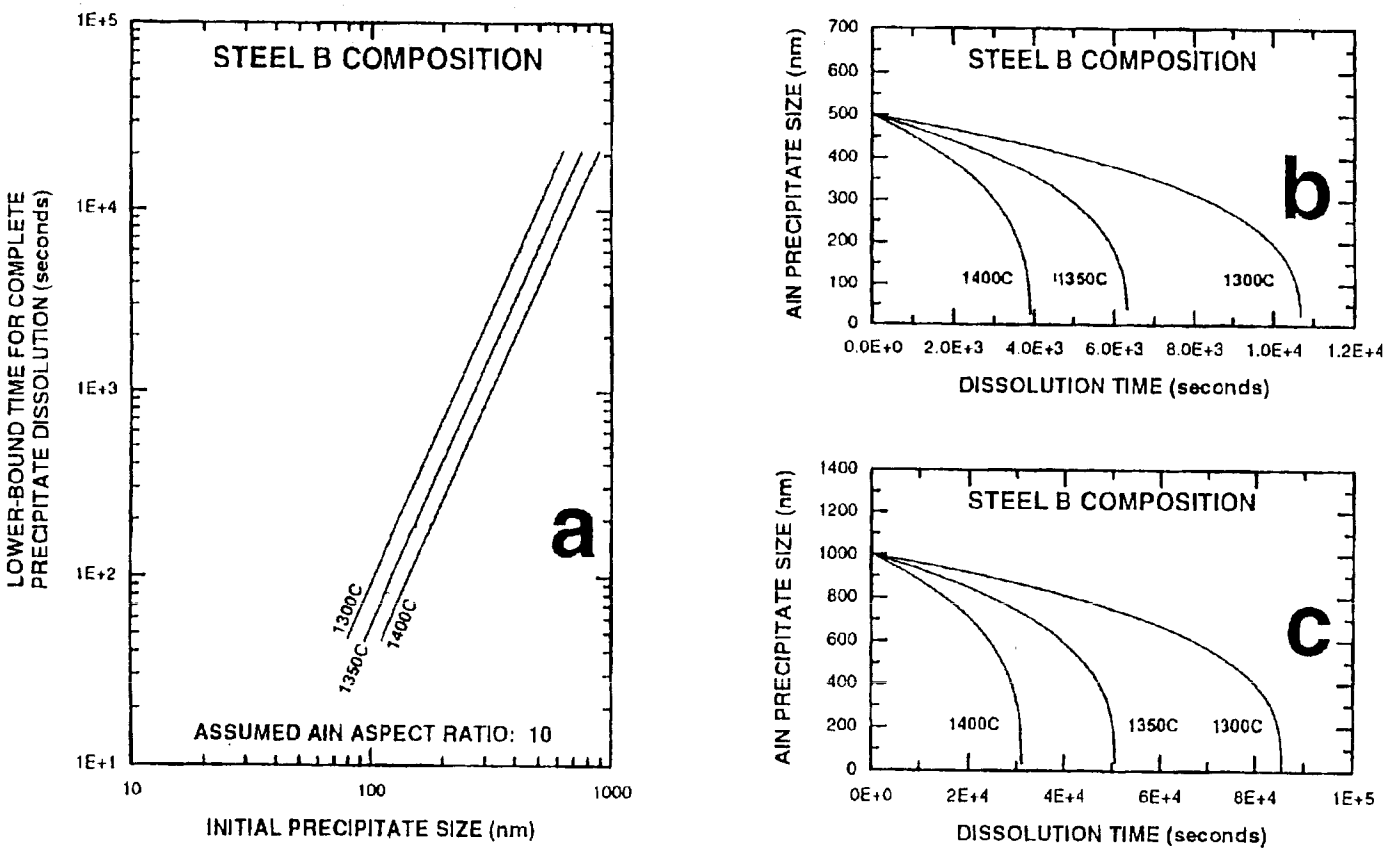
FIGS. 4*a*–4*c* are graphs illustrating calculated estimates of the isothermal dissolution behavior of AlN in austenite at temperatures of 1300° C., 1350° C., and 1400° C. for the steel B composition of Table 1.

There are two general approaches to applying the post-solidification processing technology of the present invention. First post-solidification cooling can be interrupted with an isothermal anneal at temperatures above about 1300° C. Based on the kinetic model of Cheng, Hawbolt, and Meadowcroft ($40^{th}$ Mechanical Working & Steel Processing Conference Proceedings, Iron and Steel Society, Inc., 1998, pp. 947–957), calculated estimates of the isothermal dissolution behavior for the steel B composition are shown in FIGS. 4*a*–4*c*. These data suggest that AlN precipitates with an initial size of 500 nm will completely dissolve in a reasonable amount of time (i.e., about three hours) at temperatures as low as 1300° C. However, the complete dissolution of 1 μm AlN precipitates is predicted to require about 8.5 hours at 1400° C. Thus, an isothermal anneal can be incorporated into post-solidification processing without regard to the cooling rate of the steel preceding the anneal, although this method of processing will be inefficient if the post-solidification cooling rate of the steel is comparatively high (e.g., the near-surface regions of a cast section).

Figure 5:
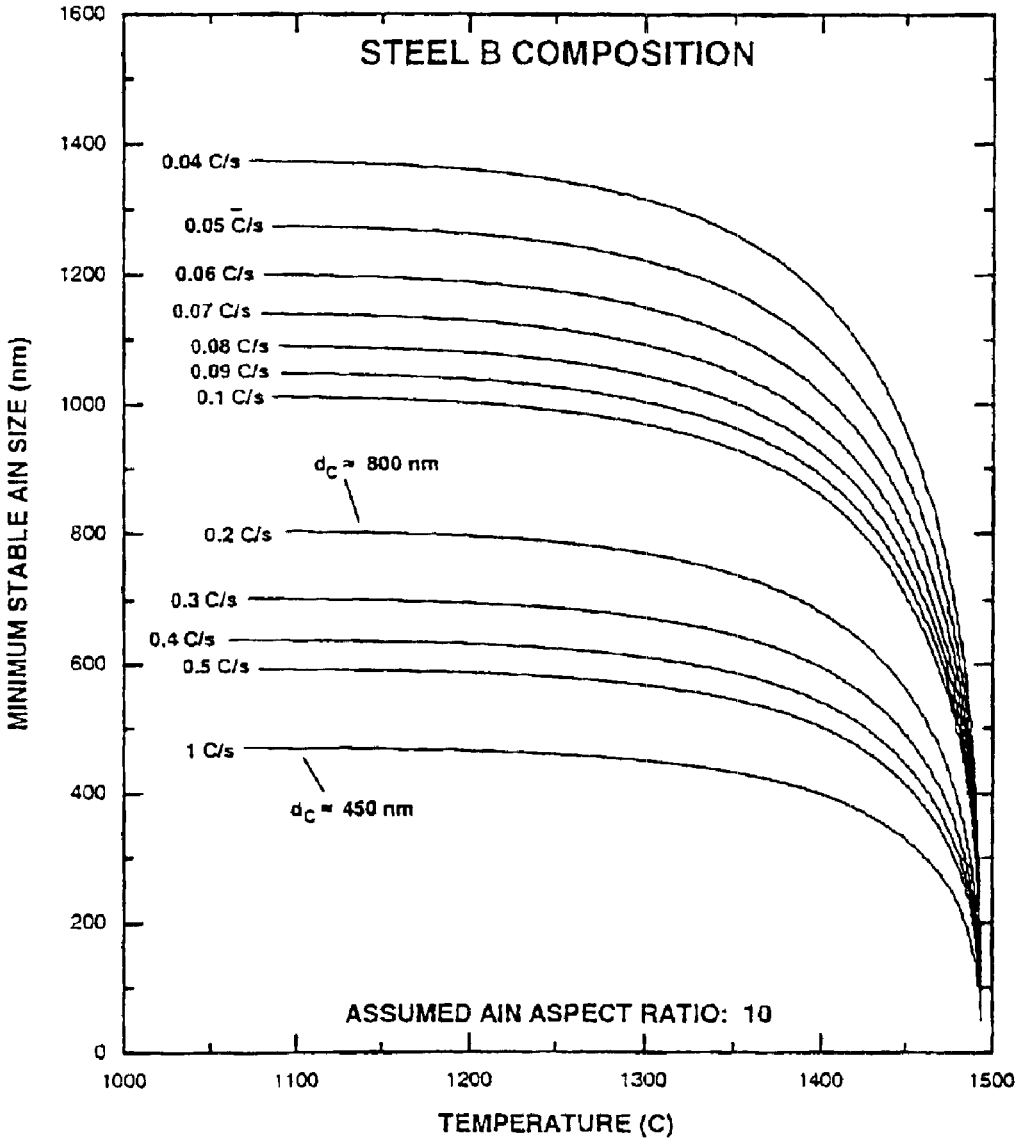
FIG. 5 is a graph illustrating the dependence of the minimum size of AlN precipitate that will be retained through post-solidification cooling on temperature and post-solidification cooling rate for the steel B composition of Table 1.

The preferred method of post-solidification processing according to the present invention comprises continuous cooling at a reduced rate from the solidification temperature to a temperature above the equilibrium AlN solution temperature for a steel. In this manner, post-solidification processing can be more effectively leveraged to take advantage of enhanced precipitate dissolution kinetics at temperatures in the vicinity of the solidification temperature. The minimum size of AlN precipitate that is predicted to be retained through post-solidification cooling is shown as a function of temperature and cooling rate in FIG. 5 for the steel B composition, again based on the general kinetic model of Cheng, Hawbolt, and Meadowcroft. The model predictions, which are based on an assumed precipitate aspect ratio of 10, suggest that 1 μm AlN precipitates will completely dissolve if post-solidification cooling is conducted at rates of 0.04°

C./s and 0.08° C./s from the solidification temperature to 1445° C. and 1350° C., respectively.

As applied to ingot cast steel, the most commercially viable method of slow cooling the steel according to the present invention comprises stripping the as-solidified steel from the ingot mold at the highest feasible temperature after solidification, followed by slow cooling in a furnace maintained at a temperature well above a solution temperature for the relevant species of grain-refining precipitate (e.g., 1250–1300° C.). The ingots can be slow cooled at an appropriate rate to a temperature defined in terms of the maximum expected size of AlN precipitate that forms during solidification, or the steel can be slow cooled and subsequently equilibrated in the furnace.

Since cooling rate varies with position in large cast sections, gradations in the size and content of coarse precipitates will exist throughout the columnar zone of a casting. The model predictions of FIG. 5, for example, suggest that AlN precipitates with initial sizes larger than about 600 nm and about 1.3 $\mu$m could be retained through post-solidification cooling at rates of 0.5° C./s and 0.05° C./s, respectively. Considering precipitate size distributions are typically represented by an exponential function, material cooled at 0.5° C./s will possess a higher density of both intermediate-sized and coarse precipitates and exhibit lower toughness than material cooled at 0.05° C./s. Alternatively, if the maximum size of AlN precipitate that forms during solidification is about 1 $\mu$m, the model predictions of FIG. 5 indicate that post-solidification cooling at rates below about 0.1° C./s will effectively eliminate coarse precipitates from the microstructure. Depending on the maximum size of AlN precipitate that forms during solidification and the size, geometry, and heat transfer characteristics of a cast section, the method of the present invention can be applied to effect precipitate dissolution through the entire columnar zone or a portion of the columnar zone in a cast section.

There are three general requirements that define the range of applicability of the process of the present invention. First, a steel must possess a carbon content in the approximate 0.09–0.17 wt. % range; that is, the steel must contain a substantial amount of δ ferrite during solidification. Second, solute enrichment in the liquid phase must be severe enough to exceed a solubility limit for a relevant species of grain-refining precipitate during solidification. These two requirements provide necessary conditions for the formation of extremely coarse grain-refining precipitates in the as-solidified steel. Finally, the equilibrium solution temperature of the relevant species of grain-refining precipitate in austenite must be substantially less than the solidification temperature of the steel. This latter requirement effectively defines the efficiency with which the process can be applied from the standpoint that the driving force for precipitate dissolution scales in proportion to the difference between the solidification temperature of the steel and the equilibrium solution temperature of the precipitate phase(s). In other words, the method of the present invention is generally applicable to any precipitate species that degrades the toughness of heat-treated steels containing about 0.09–0.17 wt. % C when the latter two requirements are satisfied.

It should be noted that while the model predictions may be of limited accuracy in an absolute sense, the model correctly indicates the general effects of time, temperature, and post-solidification cooling rate on the propensity to retain coarse AlN precipitates in the microstructure. In this context, it should also be recognized that other variations and/or modifications to the process not described herein are possible without departing from the spirit and scope of the present invention.

I claim:

1. A method for improving the toughness of a high-strength steel containing in % by weight about 0.09% to 0.17% C, 0.005% to 0.05% Al, and more than about 60 ppm N, comprising the steps of:

(a) casting said steel to provide a hot, solidified steel shape;

(b) cooling the hot solidified steel shape in a thermally controlled environment from a temperature near a solidification temperature of the steel at a rate of 1° C./second or less to a temperature in excess of an equilibrium solution temperature for AlN in austenite for a sufficient amount of time to effect the dissolution of coarse AlN precipitates in a microstructure of said hot solidified steel shape; and (c) further cooling the hot solidified steel shape to room temperature or to a primary hot-rolling temperature.

2. The method of claim 1 in which the thermally controlled environment is a furnace maintained at a temperature in the 1250°–1350° C. range.

3. The method of claim 1 in which the steel also contains one or more grain-refining elements selected from the group consisting of Ti, Nb, and V, wherein equilibrium solution temperatures for both AlN and a least soluble species of carbonitride precipitate in austenite are maintained below about 1300° C.

4. A method for improving the toughness of low-alloy and alloy high-strength steels containing in % by weight about 0.09–0.17% C, 0.005–0.05% Al, and greater than about 60 ppm N, comprising:

(a) casting the steel in an ingot mold to provide a solidified steel ingot;

(b) stripping the solidified steel ingot from the ingot mold to provide a hot steel ingot;

(c) placing the solidified hot steel ingot in a furnace maintained at a temperature equal to or greater than 1250° C. and also in excess of an equilibrium solution temperature for AlN in austenite;

(d) cooling the hot steel ingot in the furnace for a sufficient amount of time from a temperature near a solidification temperature of the steel to said temperature in step (c) to dissolve coarse AlN precipitates in a microstructure of the steel; and (e) further cooling the hot steel ingot at any desired rate from said temperature in step (c) to room temperature or to a primary hot-rolling temperature.

5. The method of claim 4 in which the furnace in step (c) is maintained at a temperature of about 1250°–1350° C.

6. The method of claim 4 in which the steel also contains one or more grain-refining elements selected from the group consisting of Ti, Nb, and V, wherein equilibrium solution temperatures for both AlN and a least soluble species of carbonitride precipitate in austenite are maintained below about 1300° C.

7. A method for improving the toughness of low-alloy and alloy-strength steels, comprising the steps of:

(a) providing a high-strength melt containing in % by weight about 0.09–0.17% C, 0.005–0.05% Al, greater than about 60 ppm N, and none or one or more grain-refining elements selected from the group consisting of Ti, Nb, and V;

(b) casting the steel in an ingot mold to provide a solidified hot steel ingot;

(c) stripping the hot solidified steel ingot from the ingot mold to provide a hot steel ingot;

(d) placing the hot steel ingot in a furnace at a temperature of about 1250°–1350° C.

(e) cooling said solidified hot steel ingot in said furnace from a temperature near a solidification temperature of the steel to said temperature in step (d) for a sufficient amount of time to dissolve coarse AlN precipitates in a microstructure of said steel; and (f) further cooling the hot steel ingot to room temperature or to a primary hot-rolling temperature.

8. The method of claim 7 wherein equilibrium solution temperatures for AlN and a least soluble species of carbonitride precipitate in austenite are maintained below about 1300° C.

9. A method for improving the toughness of a high-strength steel article, comprising the steps of:

(a) providing a high strength steel containing in % by weight about 0.09% to 0.17% C, 0.005% to 0.05% Al, and more than about 60 ppm N;

(b) casting said steel to provide a hot, solidified steel shape;

(c) cooling the hot solidified steel shape in a thermally controlled environment from a temperature near a solidification temperature of the steel at a rate of 1° C./second or less to a temperature in excess of an equilibrium solution temperature for AlN in austenite for a sufficient amount of time to effect the dissolution of coarse AlN precipitates in a microstructure of said hot solidified steel shape; and (d) further cooling the hot solidified steel shape to room temperature or to a primary hot-rolling temperature; and (e) forming said article.

10. The method of claim 9 in which the thermally controlled environment is a furnace maintained at a temperature in the 1250°–1350° C. range.

11. The method of claim 9 in which the steel also contains one or more grain-refining elements selected from the group consisting of Ti, Nb, and V, wherein equilibrium solution temperatures for both AlN and a least soluble species of carbonitride precipitate in austenite are maintained below about 1300° C.

* * * * *

UNITED STATES PATENT AND TRADEMARK OFFICE

CERTIFICATE OF CORRECTION

PATENT NO. : 6,863,749 B1
DATED : March 8, 2005
INVENTOR(S) : Leap, Michael J.

It is certified that error appears in the above-identified patent and that said Letters Patent is hereby corrected as shown below:

Title page,
Item [57], ABSTRACT,
Line 3, "solidification is low-alloy" should read -- solidification in low-alloy --.

Signed and Sealed this

Twenty-seventh Day of September, 2005

JON W. DUDAS
*Director of the United States Patent and Trademark Office*